US006328621B2

(12) United States Patent
Kudoh et al.

(10) Patent No.: US 6,328,621 B2
(45) Date of Patent: Dec. 11, 2001

(54) ELECTRON GUN, CRT WITH ELECTRON GUN

(75) Inventors: Masatoshi Kudoh, Chiba-ken; Ryuichi Murai, Osaka-fu; Mitsuhiro Ohtani, Osaka-fu; Katuyoshi Yamashita, Osaka-fu; Hideharu Ohmae, Osaka-fu; Masahiko Konda, Osaka-fu, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/845,302

(22) Filed: May 1, 2001

Related U.S. Application Data

(60) Division of application No. 09/593,137, filed on Jun. 14, 2000, now Pat. No. 6,270,390, which is a continuation-in-part of application No. 08/827,714, filed on Apr. 8, 1997, now abandoned.

(30) Foreign Application Priority Data

Apr. 11, 1996 (JP) ..... 8-89221

(51) Int. Cl.[7] ..... H01J 29/62; H01J 29/56
(52) U.S. Cl. ..... 445/450
(58) Field of Search ..... 313/414, 449, 313/450

(56) References Cited

U.S. PATENT DOCUMENTS

| | | | | |
|---|---|---|---|---|
| 3,143,681 | | 8/1964 | Schlesinger . | |
| 4,139,773 | * | 2/1979 | Swanson et al. | 250/423 R |
| 4,560,899 | * | 12/1985 | Takayama et al. | 313/449 |
| 4,827,184 | | 5/1989 | Spanjer et al. . | |
| 5,127,863 | | 7/1992 | Goorhuis . | |
| 5,256,934 | | 10/1993 | Van Engelshoven et al. . | |
| 5,521,464 | | 5/1996 | Vrijssen et al. . | |
| 5,773,925 | * | 6/1998 | Kimura et al. | 313/450 |
| 6,100,630 | * | 8/2000 | Amano et al. | 313/414 |

FOREIGN PATENT DOCUMENTS

| | | |
|---|---|---|
| 63225464 | 9/1988 | (JP) . |
| 5258683 | 10/1993 | (JP) . |
| 7-73818 | 3/1995 | (JP) . |

OTHER PUBLICATIONS

"A Generalized Comparison Of Spherical Aberration Of Magnetic And Electrostatic Lenses", by A. Gorkum et al., appearing on pp. 134–136 of *Optik*, vol. 72, No. 4 (1986).
T.G. Spanjer, entitled "Optimization of the Configuration of Spinal Lenses for Minimum Spherical Aberration" pp. 18–29.
K.R. Spangenberg, entitled "Vacuum Tubes" pp. 342–343.

* cited by examiner

*Primary Examiner*—Kenneth J. Ramsey
(74) *Attorney, Agent, or Firm*—Greenblum & Bernstein, P.L.C.

(57) ABSTRACT

Method and apparatus for manufacturing an electron gun. A beam spot coefficient is obtained from an electrostatic lens magnification and a spherical aberration coefficient of a set resistance distribution. Then, a first process loop is executed to select another resistance distribution that provides an approximate minimum value of the beam spot coefficient. It is then determined whether the beam spot coefficient is an approximate minimum value. The first process loop is repeatedly executed until the beam spot coefficient is determined to be equal to the approximate minimum value. At this point, a second process loop is executed to confirm the minimum value of the beam spot coefficient using an aberration-independent function that is dependent upon the electrostatic lens magnification and is not dependent upon the spherical aberration coefficient. Processing returns to the first process loop using still another resistance distribution as a selected resistance distribution when the beam spot coefficient is not the approximate minimum value.

4 Claims, 13 Drawing Sheets

(a)

(b)

ELECTRON GUN, CRT WITH ELECTRON GUN

This application is a division of application Ser. No. 09/593,137, filed on Jun. 14, 2000, now U.S. Pat. No. 6,270,390, which application is a continuation-in-part application of application Ser. No. 08/827,714, filed on Apr. 8, 1997, abandoned, the subject matter of which is expressly incorporated herein by reference in its entirety.

BACKGROUND OF THE INVENTION

1. Field of the Invention

The present invention relates to a cathode ray tube used, for example, in a video display device, such as a television, and to an electron gun used in the cathode ray tube.

2. Description of the Prior Art

With the advent of high definition television (HDTV), a need exists for a display device that is able to resolve a resolution of, for example a 1080i (e.g., 1920 Horizontal pixels ×1080 Vertical pixels) image. Cathode ray tubes (CRTs) of a direct view televisions employ a mask that makes it difficult for such a display to resolve the full resolution of a high definition signal while maintaining a sufficient light output. Further, the desire for large screen display devices have increased over the years. Accordingly, projection-type display devices, such as, for example, rear projection televisions (RPTV) and front projection televisions (FPTV) have increased in popularity.

Rear projection televisions and front projection televisions generally employ a plurality of CRTs (e.g., a red CRT, a green CRT, and a blue CRT) to project a color image onto a screen. Such televisions generally employ CRTs having a face diameter of between 7 inches and 12 inches. It is noted that in general, the larger the diameter of the CRT face, the higher the resolution capability of the CRT. A lens is generally mounted to the front of each CRT to magnify the projected image to a desired size.

Two methods are known for focusing the image produced by an electron beam of the CRT; namely, an electrostatic focusing system and a magnetic (electromagnetic) focusing system. In order to achieve a high resolution display, it is necessary to reduce a spherical aberration in an electrostatic lens or a magnetic lens. The spherical aberration can generally be reduced by increasing the lens diameter.

The outside diameter of an electrostatic lens is generally limited by the neck diameter of the cathode ray tube. While such a limitation is not applicable to the magnetic lens system, magnetic lens systems consume additional electrical power and add additional weight (relative to the electrostatic focusing system).

U.S. Pat. No. 3,143,681 discloses the reduction of a spherical aberration in an electrostatic lens that is not limited by the neck diameter. In this patent, the neck diameter of the CRT is effectively enlarged by means of an electrostatic lens comprising a resistive structure having a coil pattern.

An electrostatic lens having a resistive structure comprising plural coil segments and plural intermediate segments that are alternately disposed is disclosed in Japanese Unexamined Patent Publication SHO 63-225464.

An article published at pages 134 to 136 of a magazine entitled OPTIK (Vol. 72, No. 4, 1986) describes a method for determining the length of the coil segments and intermediate segments in the direction of an electron beam trajectory. This article teaches that a minimum diameter of a beam spot formed on the screen is proportional to $C0^{1/4}$, where C0 is equal to a minimum value (e.g., a minimum beam spot coefficient) of a beam spot coefficient C shown in equation (2), below. A spherical aberration coefficient Cs of the electrostatic lens used to calculate equation (2) is calculated from an integral of a z-axis, i.e., a direction of travel of an electron beam, based on equation (4), below.

$$C = M^4 \cdot Cs \cdot \left(\frac{Vs}{V0}\right)^{\frac{3}{2}} \tag{2}$$

$$Cs = \frac{1}{64\sqrt{V0}} \int_{Z0}^{Zs} \frac{r^4}{V'} \left\{ 10\left(\frac{V'}{V}\right)^4 - 10\left(\frac{V'}{V}\right)^2 \left(\frac{V''}{V}\right) + 4\left(\frac{V''}{V}\right)^2 - \left(\frac{V'}{V}\right)\left(\frac{V'''}{V}\right) \right\} dz \tag{4}$$

where:

M is equal to a magnification of the electrostatic lens;

Vs is equal to a voltage on an emission side;

V0 is equal to a voltage on an incidence side;

Z0 is equal to a z-axis coordinate of an electro-optical object point produced by the electron beam;

Zs is equal to the object point (i.e., the z-axis coordinate of the spot formed on the screen);

r is equal to a radius of a paraxial path of the electron beam emitted at an angle of 1 radian from the object point;

V is equal to a potential distribution on a central axis of a tubular substrate; and V', V", and V'" are first, second, and third derivatives of potential distribution V.

As disclosed in the OPTIK article, equations (2) and (4) are repeatedly calculated using a computer simulation model to determine a length of plural tubular film members of the CRT and a length of plural coil members of the CRT, until the beam spot coefficient C obtained by equation (2), above, is reduced to the minimum beam spot coefficient C0.

An electron gun constructed in accordance with the OPTIK article for forming a unipotential electrostatic lens in which the incidence-side voltage V0 is equal to an emissions-side voltage Vs is further disclosed in Japanese Unexamined Patent Publication HEI 7-73818.

However, when the specified voltage is applied to the resistive structure to drive the conventional CRT disclosed above, a sufficiently small beam spot (required for producing the high resolution (high definition) image) cannot be formed on the screen. That is, the empirical results obtained from the actual construction of a CRT in accordance with the above differs from the theoretical results produced by the computer simulation. Specifically, the actual diameter of the beam spot of a CRT produced with conventional manufacturing methods differs by approximately 10% to 20%, as compared to the results indicated by the computer simulations.

It is also known that the diameter of the beam spot varies over time as an electrical power supply to the electron gun is varied. This time-based fluctuation in the beam spot diameter results in instability in the brightness of the displayed image over time.

SUMMARY OF THE INVENTION

Accordingly, an object of the present invention is to provide a cathode ray tube that is capable of displaying high resolution images with a stable brightness over time by finding a resistance distribution in which the beam spot coefficients C and Cm are minimized.

A further object of the invention is to provide an electron gun having a resistive structure that reduces a time-based change of the spot diameter. The resistive structure comprises, for example, a resistance film of which a resistance on the electron beam emission side is greater than an average overall resistance of the film.

According to an advantage of the invention, an electron gun reduces the time-based change in the spot diameter by, for example, employing a construction in which the inside diameter of the tubular substrate and the length of the plural coil members nearest the electron beam emission side satisfy particular conditions.

According to an object of the invention, a method is disclosed for manufacturing an electron gun. A beam spot coefficient is obtained from an electrostatic lens magnification and a spherical aberration coefficient of a set resistance distribution. A first process loop is then executed to select another resistance distribution that provides an approximate minimum value of the beam spot coefficient. Thereafter, it is determined whether the beam spot coefficient is an approximate minimum value. The first process loop is repeatedly executed until the beam spot coefficient is determined to be equal to the approximate minimum value. At that point, a second process loop is executed to confirm the minimum value of the beam spot coefficient using an aberration-independent function that is dependent upon the electrostatic lens magnification and is not dependent upon the spherical aberration coefficient, with the processing returning to the first process loop using still another resistance distribution as a selected resistance distribution when the beam spot coefficient is not the approximate minimum value.

According to a feature of the invention, execution of the first process loop comprises obtaining the approximate minimum value of the beam spot coefficient by substituting in Equation (A) a spherical aberration coefficient Cs obtained from Equation (B) and the electrostatic lens magnification M obtained from Equation (C), as follows:

$$C = M^4 \cdot Cs \cdot \left(\frac{Vs}{V0}\right)^{\frac{3}{2}} \tag{A}$$

$$Cs = \frac{1}{64\sqrt{V0}} \int_{Z0}^{Zs} \frac{r^4}{V'} \left\{ 10\left(\frac{V'}{V}\right)^4 - 10\left(\frac{V'}{V}\right)^2 \left(\frac{V''}{V}\right) + 4\left(\frac{V''}{V}\right)^2 - \left(\frac{V'}{V}\right)\left(\frac{V'''}{V}\right) \right\} dz \tag{B}$$

$$M = \frac{\sqrt{V0}}{r'(Zs)} \tag{C}$$

in which:

C is equal to a beam spot coefficient;

Vs is equal to a voltage on an emission side;

V0 is equal to a voltage on an incidence side;

Z0 is equal to a z-axis coordinate of an electro-optical object point produced by the electron beam;

Zs is equal to the object point (i.e., the z-axis coordinate of the spot formed on the screen);

r is equal to a radius of a paraxial path of the electron beam emitted at an angle of 1 radian from the object point;

V is equal to a potential distribution on a central axis of a tubular substrate;

V', V", and V'" are first, second, and third derivatives of potential distribution V; and r'(Zs) is a slope at an image point (Z=Zs) on a paraxial path of the electron beam emitted at the angle of 1 radian from the object point (Z=Z0).

According to another feature of the invention, execution of the second process loop comprises confirming the minimum value of the beam spot coefficient by substituting, in Equation (D) the aberration-independent function obtained by substituting the electrostatic lens magnification and minimum value of the beam spot coefficient into Equation (E), as follows:

$$Cm = (1 - a) \cdot M^4 \cdot Cs \cdot \left(\frac{Vs}{V0}\right)^{\frac{3}{2}} + a \cdot F \tag{D}$$

$$F = \left(\frac{M}{M0}\right)^4 \cdot C0 \tag{E}$$

in which:

M0 equals a minimum magnification value;

C0 equals a minimum value of the beam spot coefficient C;

Cm equals the confirmed minimum value of the beam spot coefficient;

parameter "a" equals a modification parameter value; and

F equals the aberration-independent function.

Another object of the instant invention pertains to a method for manufacturing an electron gun. According to this method, a first beam spot coefficient is obtained from an electrostatic lens magnification and a spherical aberration coefficient of a predetermined resistance distribution. A first process loop is then executed to find a predetermined resistance distribution that provides an approximate minimum value of a first beam spot coefficient. Then, it is determined whether the first beam spot coefficient is an approximate minimum value. The first process loop is repeatedly executed until the first beam spot coefficient is determined to be equal to the approximate minimum value. Once the first process loop determines the approximate minimum value of the first beam spot, a second process loop is executed to find another resistance distribution that provides an approximate minimum value of a second beam spot coefficient by determining whether the second beam spot coefficient is an approximate minimum value, where the second beam spot coefficient is obtained by modifying the approximate minimum value of the first beam spot coefficient and an aberration-independent function that is dependent upon the electrostatic lens magnification and is not dependent upon the spherical aberration coefficient. In this regard, processing then returns to the first process loop, using the predetermined resistance distribution as the selected resistance distribution, when the second beam spot coefficient is determined to not be the approximate minimum value.

According to an advantage of the invention, the execution of the first process loop comprises obtaining the approximate minimum value of the first beam spot coefficient by substituting in Equation (A) a spherical aberration coefficient Cs obtained from Equation (B) and the electrostatic lens magnification M obtained from Equation (C), as follows:

$$C = M^4 \cdot Cs \cdot \left(\frac{Vs}{V0}\right)^{\frac{3}{2}} \tag{A}$$

-continued $$Cs = \frac{1}{64\sqrt{V0}} \int_{Z0}^{Zs} \frac{r^4}{V'} \left\{ 10\left(\frac{V'}{V}\right)^4 - 10\left(\frac{V'}{V}\right)^2 \left(\frac{V''}{V}\right) + 4\left(\frac{V''}{V}\right)^2 - \left(\frac{V'}{V}\right)\left(\frac{V'''}{V}\right) \right\} dz \quad \text{(B)}$$

$$M = \frac{\sqrt{V0}}{r'(Zs)} \quad \text{(C)}$$

in which:

C is equal to a beam spot coefficient;

M is equal to an electrostatic lens magnification;

Vs is equal to a voltage on an emission side;

V0 is equal to a voltage on an incidence side;

Z0 is equal to a z-axis coordinate of an electro-optical object point produced by the electron beam;

Zs is equal to the object point (i.e., the z-axis coordinate of the spot formed on the screen);

r is equal to a radius of a paraxial path of the electron beam emitted at an angle of 1 radian from the object point;

V is equal to a potential distribution on a central axis of a tubular substrate;

V', V", and V'" are first, second, and third derivatives of potential distribution V; and r'(Zs) is a slope at an image point (Z=Zs) on a paraxial path of the electron beam emitted at the angle of 1 radian from the object point (Z=Z0).

According to another feature, executing the second process loop comprises obtaining the approximate minimum value of the second beam spot coefficient by substituting, in Equation (D), defined below, the aberration-independent function obtained by substituting the electrostatic lens magnification and minimum value of the beam spot coefficient into Equation (E), defined below, as follows:

$$Cm = (1-a) \cdot M^4 \cdot Cs \cdot \left(\frac{Vs}{V0}\right)^{\frac{3}{2}} + a \cdot F \quad \text{(D)}$$

$$F = \left(\frac{M}{M0}\right)^4 \cdot C0 \quad \text{(E)}$$

in which:

M0 equals a minimum magnification value;

Cm equals the confirmed minimum value of the beam spot coefficient;

a equals a modification parameter value; and

F equals the aberration-independent function.

A still further object of the invention concerns an electrostatic lens for focusing an electron beam produced by an electron beam formation region of an electron gun. The electrostatic lens comprises a tubular substrate, and a resistive structure having a predetermined resistance distribution. The resistive structure satisfies the equation:

$$Cm = (1-a) \cdot M^4 \cdot Cs \cdot \left(\frac{Vs}{V0}\right)^{\frac{3}{2}} + a \cdot F$$

in which:

Cm equals a minimized beam spot coefficient;

a equals a modification parameter;

M equals a magnification of the electrostatic lens;

Cs equals a spherical aberration coefficient of the electrostatic lens;

Vs equals an emission-side voltage;

V0 equals an incidence-side voltage; and

F equals an aberration-independent function.

According to an advantage of the invention, the aberration-independent function is determined in accordance with the equation:

$$F = \left(\frac{M}{M0}\right)^4 \cdot C0$$

in which:

M0 equals a minimum value of the magnification M; and

C0 equals a minimum beam spot coefficient value.

According to a feature of the invention, the modification parameter a is within the range 0<a<1. Further, a film thickness of the resistive film on the emission side of the electron beam is thinner than an average film thickness of an entire resistance film.

BRIEF DESCRIPTION OF THE DRAWINGS

The foregoing and other objects, features and advantages of the invention will be apparent from the following more particular description of preferred embodiments, as illustrated in the accompanying drawings which are presented as a non-limiting example, in which reference characters refer to the same parts throughout the various views, and wherein.

DESCRIPTION OF PREFERRED EMBODIMENTS

The particulars shown herein are by way of example and for purposes of illustrative discussion of embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the present invention may be embodied in practice.

Embodiment 1

Figure 1:
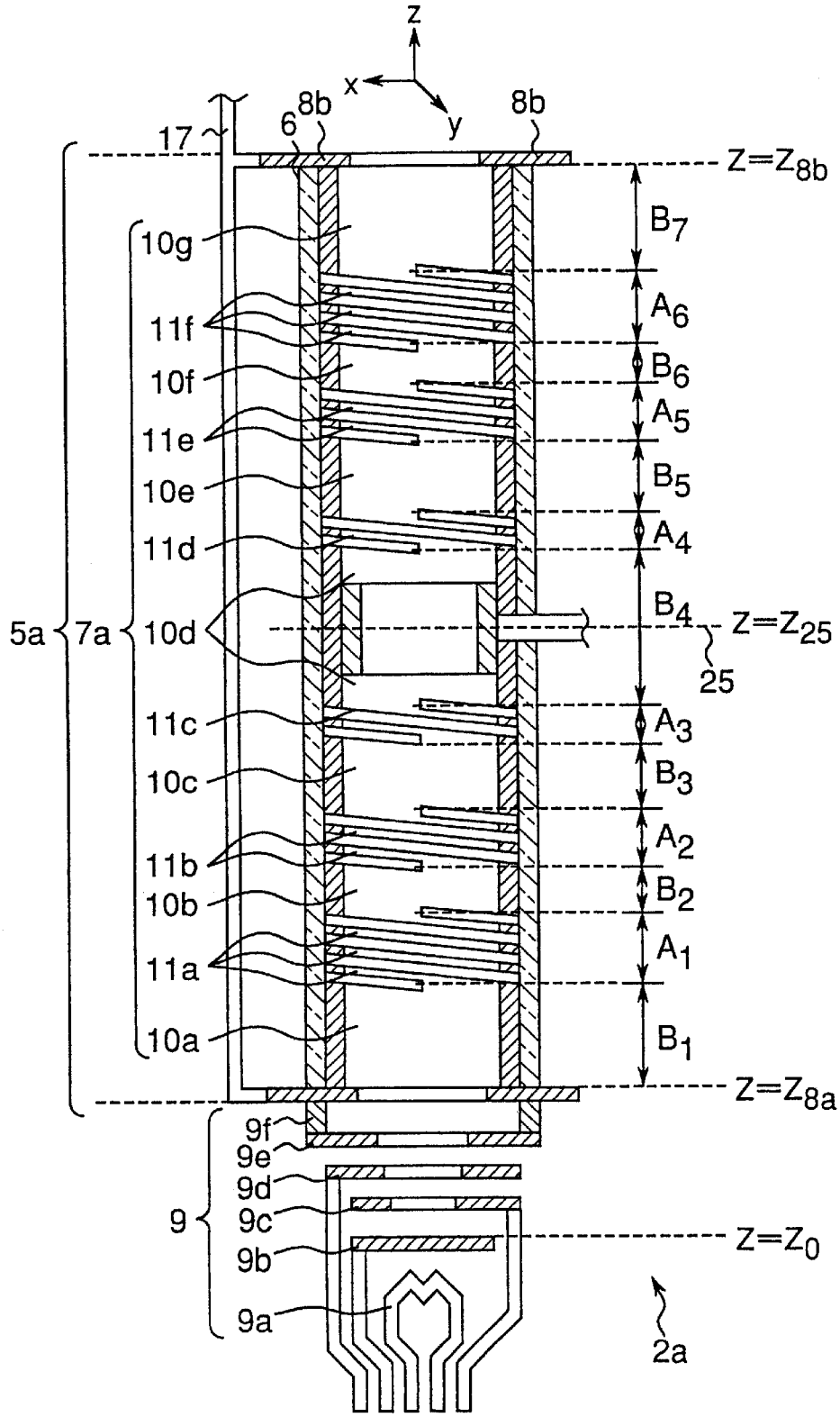
FIG. 1 illustrates a cross section of an electron gun according to a first embodiment of the present invention.

FIG. 1 shows a cross section of an electron gun according to a first embodiment of the present invention.

Referring to FIG. 1, an electron gun 2*a* comprises an electrostatic lens 5*a* and an electron beam formation region 9. The electrostatic lens 5*a* includes a tubular substrate 6, a resistive structure 7*a*, and a plurality of electrical connectors 8*a*, 8*b*, and 8*c*, and has its primary plane 25 positioned at Z=Z25 on the z-axis.

Electrical connectors 8*a* and 8*b* are thin wall metal plates disposed perpendicularly to the z-axis at both ends of the tubular substrate 6, and have an aperture in the center thereof. The electrical connectors 8*a* and 8*b* are used to establish an electrical connection a lead wire 17. In the disclosed embodiment, electrical connector 8*c* (FIG. 2) comprises a metal ring disposed to the middle of the resistive structure 7*a*, and is electrically connected to an external member through a hole provided in the side wall of the tubular substrate 6.

The electron beam formation region 9 comprises a heater 9*a*, an electron source 9*b*, a plurality of control electrodes 9*c*, 9*d*, and 9*e*, and a ring electrode 9*f*. The control electrodes 9*c*, 9*d*, and 9*e* of the current embodiment comprise thin-wall metal plates that are disposed perpendicular to the z-axis, and have an aperture in the center thereof. The ring electrode 9*f* comprises a metal tube.

The tubular substrate 6 is a substantially cylindrical substrate that exhibits electrical insulation properties. For example, the tubular substrate 6 of the current embodiment forms a glass tube. In the disclosed embodiment, the resistive structure 7*a* is formed on an inside wall of the tubular substrate 6, and comprises a plurality of cylindrical film segments 10*a*, 10*b*, 10*c*, 10*d*, 10*e*, 10*f*, and 10*g*, and a plurality of coil segments 11*a*, 11*b*, 11*c*, 11*d*, 11*e*, and 11*f*, which are made from a $RuO_2$ glass paste film having an approximate 5 Megohm sheet resistance. The coil segments 11*a* to 11*f* are resistance films formed in a particular spiral pattern.

While the disclosed embodiment teaches the resistive structure 7*a* being formed on the inside wall of the tubular substrate 6, it is understood that the resistive structure 7*a* can be formed on an outer wall of the tubular substrate 6 without departing from the spirit and/or scope of the invention.

The plurality of coil segments 11*a* to 11*f* are formed with the same pitch, with each coil segment having a particular length A1 to A6 in the z-axis direction. Similarly, the cylindrical film segments 10*a* to 10*g* have a predetermined particular length B1 to B6 in the z-axis direction. The resistive structure 7*a* has an optimized resistance distribution Rzm that is dependent upon the coil pattern. It is noted that for simplicity below the phrase "length in the z-axis direction" is hereafter referred to as the "length".

When the incidence-side voltage V0, emission-side voltage Vs, and focusing voltage Vf are applied to electrical connectors 8*a*, 8*b*, and 8*c*, respectively, the coil segments 11*a* to 11*f* function as voltage dividers. A potential distribution V(z), corresponding to the resistance distribution Rzm, occurs along the central axis of the tubular substrate 6 inside the electrostatic lens 5*a*.

Figure 2:
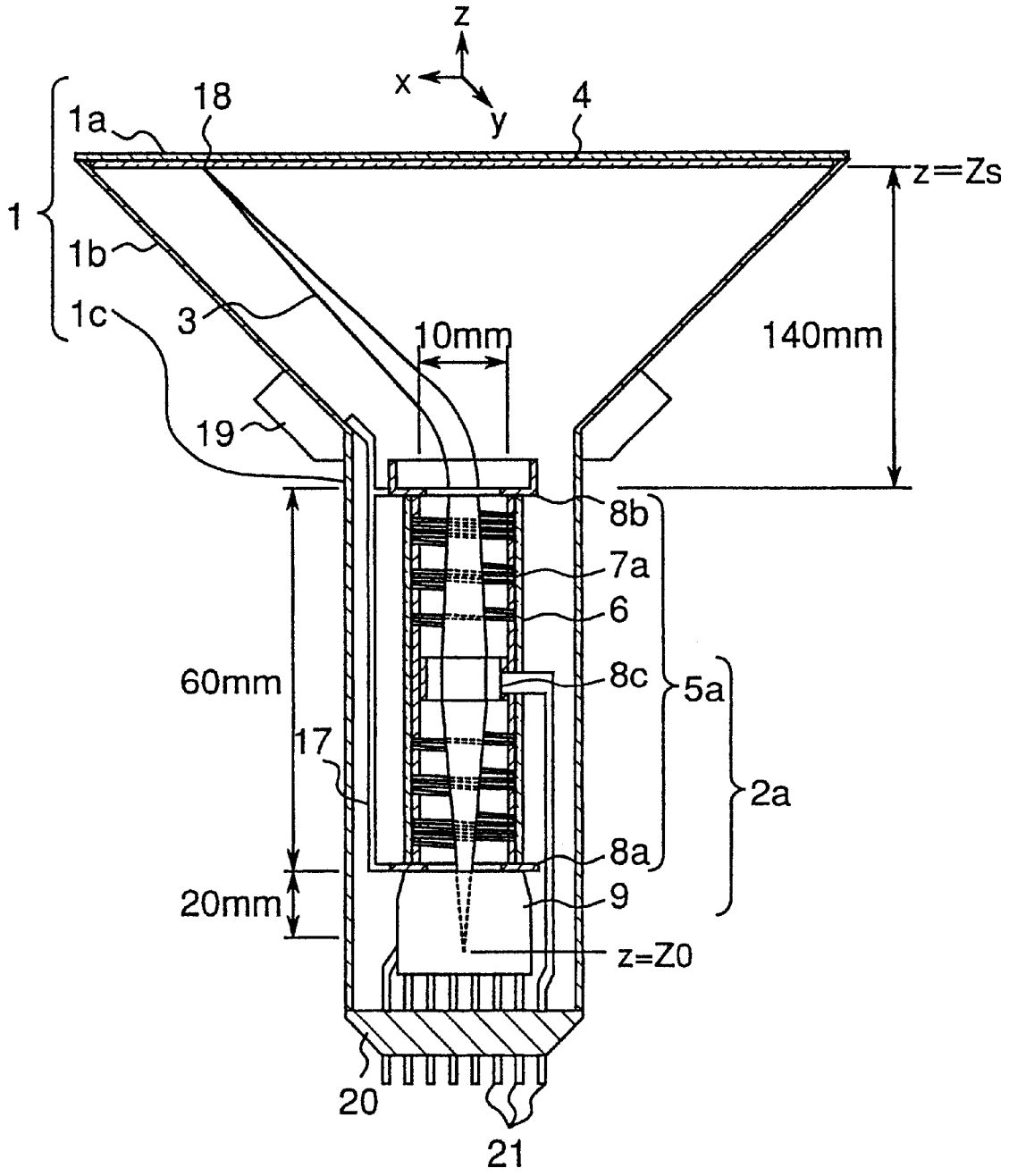
FIG. 2 illustrates a cross section of a cathode ray tube using the electron gun of the first embodiment of the invention.

FIG. 2 shows a cross section of the basic structure of a cathode ray tube using the electron gun 2*a* shown in FIG. 1.

As shown in FIG. 2, a vacuum enclosure 1 comprises an optically transparent face plate 1*a*, a cone 1*b*, and a neck 1*c*. A phosphor screen 4 is formed on an inside surface of the face plate 1*a*. A conductive layer (not shown) is formed on the inside surface of the cone 1*b* and on the screen 4, and is electrically connected to the outside by an anode button (not shown) disposed to the cone 1*b*.

A magnetic deflection yoke 19 is disposed on the outside surface of the vacuum enclosure 1 proximate a joint between the neck 1*c* and the cone 1*b*. An end cap 20, comprising a plurality of pins 21 for electrically connecting the electron gun 2*a* to external circuit elements, is fused to the neck 1*c*. In the disclosed embodiment, the electron gun 2*a* is disposed substantially coaxially to the neck 1*c*.

The operation of the cathode ray tube will now be described below.

A predetermined voltage is applied to the plurality of pins 21 to apply, for example, a screen voltage of approximately 30,000 volts to the conductive layer formed on the screen 4. When the electron beam 3, emitted and focused by the electron gun 2*a*, impinges (bombards) the screen 4, a spot 18 is formed on the screen 4 by the resulting luminescence of the phosphor film. It is noted that, due to the presence of lead wire 17 in the disclosed embodiment, that provides an electrical connection between electrical connectors 8*a* and 8*b*, the screen voltage is equal to the emission-side voltage Vs in the present embodiment.

The magnetic deflection yoke 19 controls a magnetic field that is produced on a plane that is roughly parallel to the face plate 1*a*. The magnetic field is defined by the x-axis (horizontal) and y-axis (vertical). The position of the spot 18 is controlled and changed by controlling the magnetic field to deflect the electron beam 3. The diameter of the spot (e.g., the beam spot diameter) of the electron beam 3 is controlled by controlling the beam current of the electron beam 3 produced by the electron gun 2*a* to obtain a spot of the desired brightness. The desired image is displayed on the screen 4 by controlling the position and size of the electron beam spot.

Figure 3:
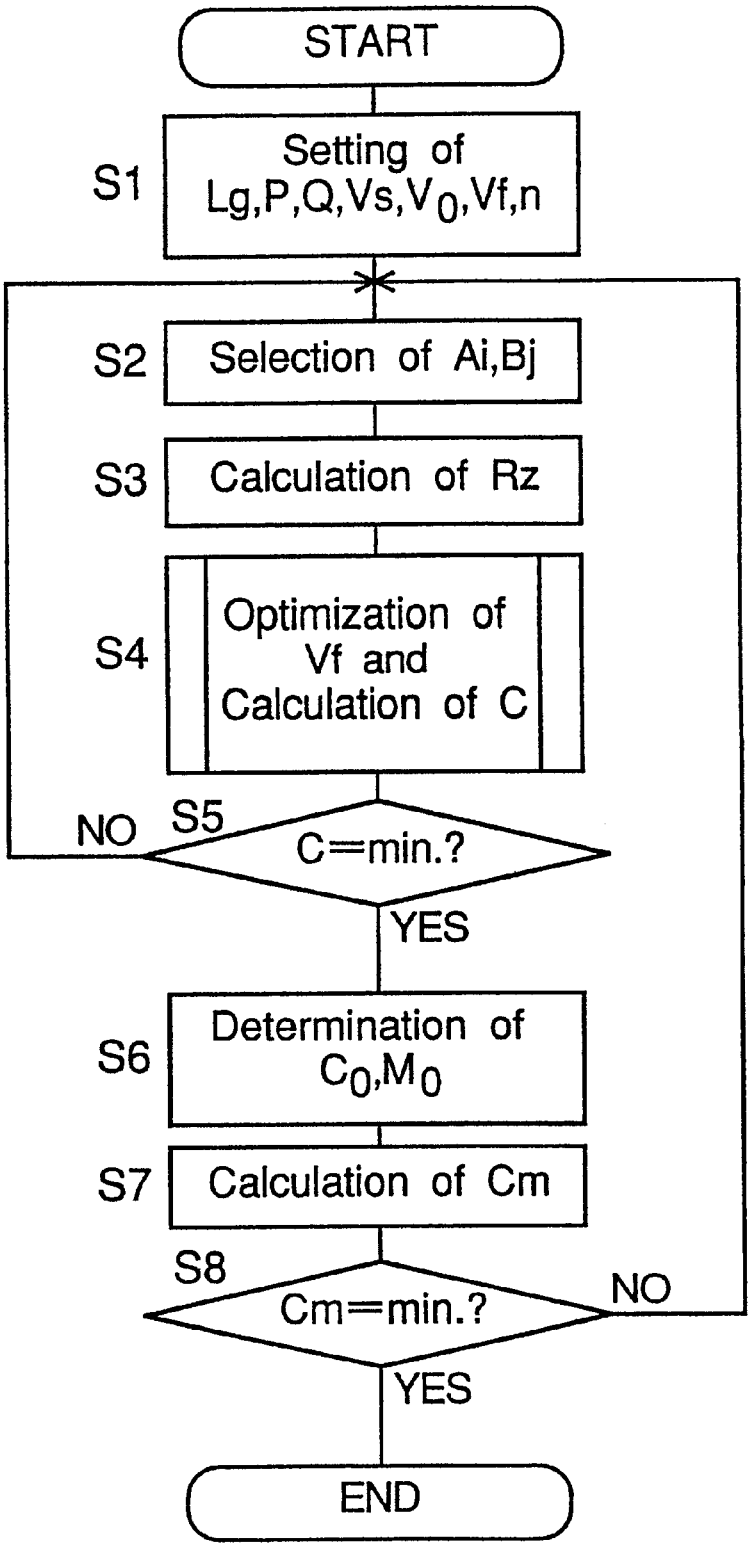
FIG. 3 illustrates a flow chart of a manufacturing method of the present invention.

A method for manufacturing the electron gun for achieving an ideal resistance distribution Rzm according to the present invention will now be described with reference to the accompanying figures, in which FIG. 3 represents a flow chart of the manufacturing method of the present invention.

As shown in FIG. 3, at step S1, several parameters are input. Specifically, a distance P from an electro-optical object point (Z=Z0) to the primary plane 25 of the electrostatic lens is inputted; a distance Q from the primary plane 25 of the electrostatic lens to an image point is inputted; the incidence-side voltage V0 is inputted; the emission-side voltage Vs is inputted; a focusing voltage Vf is inputted; a length Lg of the glass tube is inputted; and, the total number of coils n are inputted. It is noted that in the preferred embodiment of the invention, the emission-side voltage Vs and the incidence-side voltage V0 are equal. It is further noted that the value of parameter "a", to be discussed below, is equal to 0.2 in this embodiment.

Lengths B1 to Bn+1 of the cylindrical film segments 10*a* to 10*g*, along with the lengths A1 to An of the coil segments 11*a* to 11*f* are then selected at step S2. At step S3 , resistance distribution Rz of the resistive structure 7*a* is calculated based upon the lengths of the cylindrical film segments and the lengths of the coil segments.

Based upon the resistance distribution Rz obtained in step S3, a subroutine (step S4) is executed to optimize the focusing voltage Vf, and then, using the optimized focus voltage Vf, calculate the beam spot coefficient C at the optimum focusing voltage Vf.

The subroutine executed at step S4, will now be described with reference to FIG. 4.

A focusing voltage Vf is initially inputted (selected) at step S41. Then, the potential distribution V(z) on the z-axis is calculated at step S42, using the resistance distribution Rz and voltage values V0, Vs, and Vf Based upon the potential distribution V(z) calculated in step S41, the spherical aberration coefficient Cs is calculated (obtained), at step S43, in accordance with equation (4).

$$Cs = \frac{1}{64\sqrt{V0}} \int_{Z0}^{Zs} \frac{r^4}{V'} \left\{ 10\left(\frac{V'}{V}\right)^4 - 10\left(\frac{V'}{V}\right)^2\left(\frac{V''}{V}\right) + 4\left(\frac{V''}{V}\right)^2 - \left(\frac{V'}{V}\right)\left(\frac{V'''}{V}\right)\right\} dz \tag{4}$$

Figure 5:
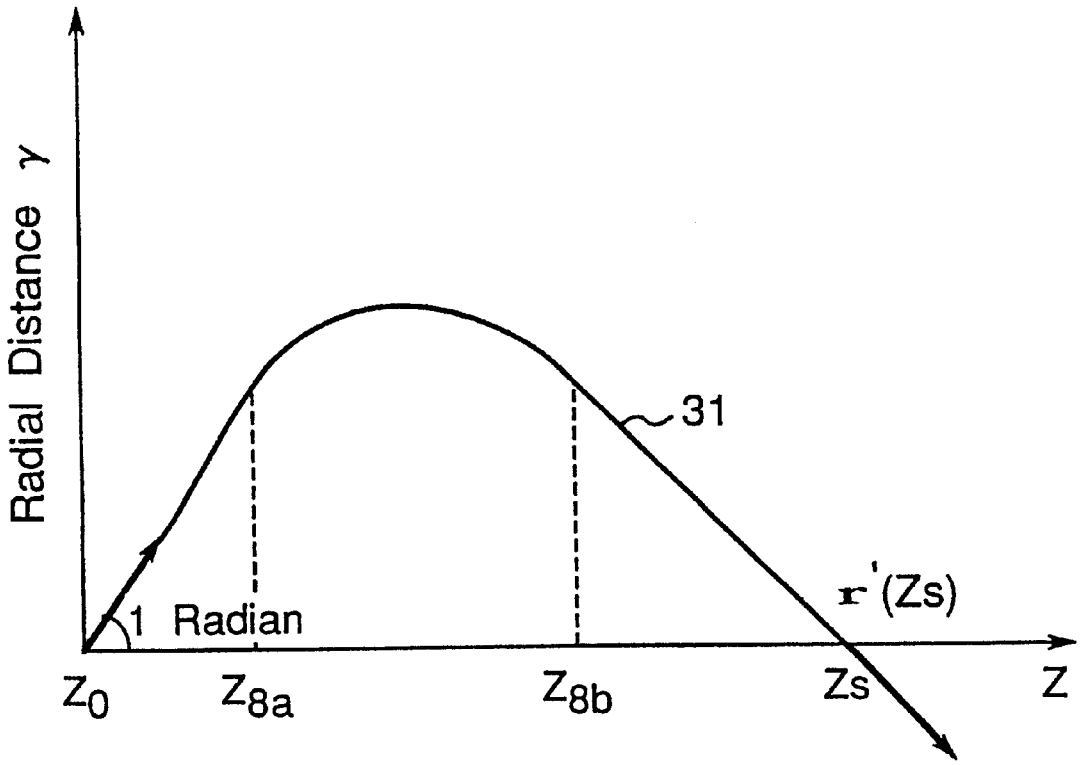
FIG. 5 illustrates a graph for describing a method of calculating a magnification M of an electrostatic lens.

A magnification M of the electrostatic lens 5*a* is also calculated at step S43 based upon a slope r'(Zs) at an image point (Z=Zs) on a paraxial path 31 (see FIG. 5) of the electron beam emitted at an angle of 1 radian from the electro-optical object point (Z=Z0), and substituting the slope r'(Zs) into equation (5).

$$M = \frac{\sqrt{V0}}{r'(Zs)} \tag{5}$$

It is noted that a method for calculating the magnification M is described, for example, by P. Grivet in ELECTRON OPTICS, Pergamon Press, Oxford, 1972.

The beam spot coefficient C is then calculated at step S44 in accordance with equation (2), above, using the magnification M of the electrostatic lens 5*a* and the spherical aberration coefficient Cs that were calculated in step S43.

Thereafter, at step S45, it is determined whether the value $C^{1/4}$, which is proportional to the electron beam spot diameter, is approximately equal to the minimum value. If the determination is negative, the routine loops back to step S41 to repeat steps S41 to S45.

Figure 4:
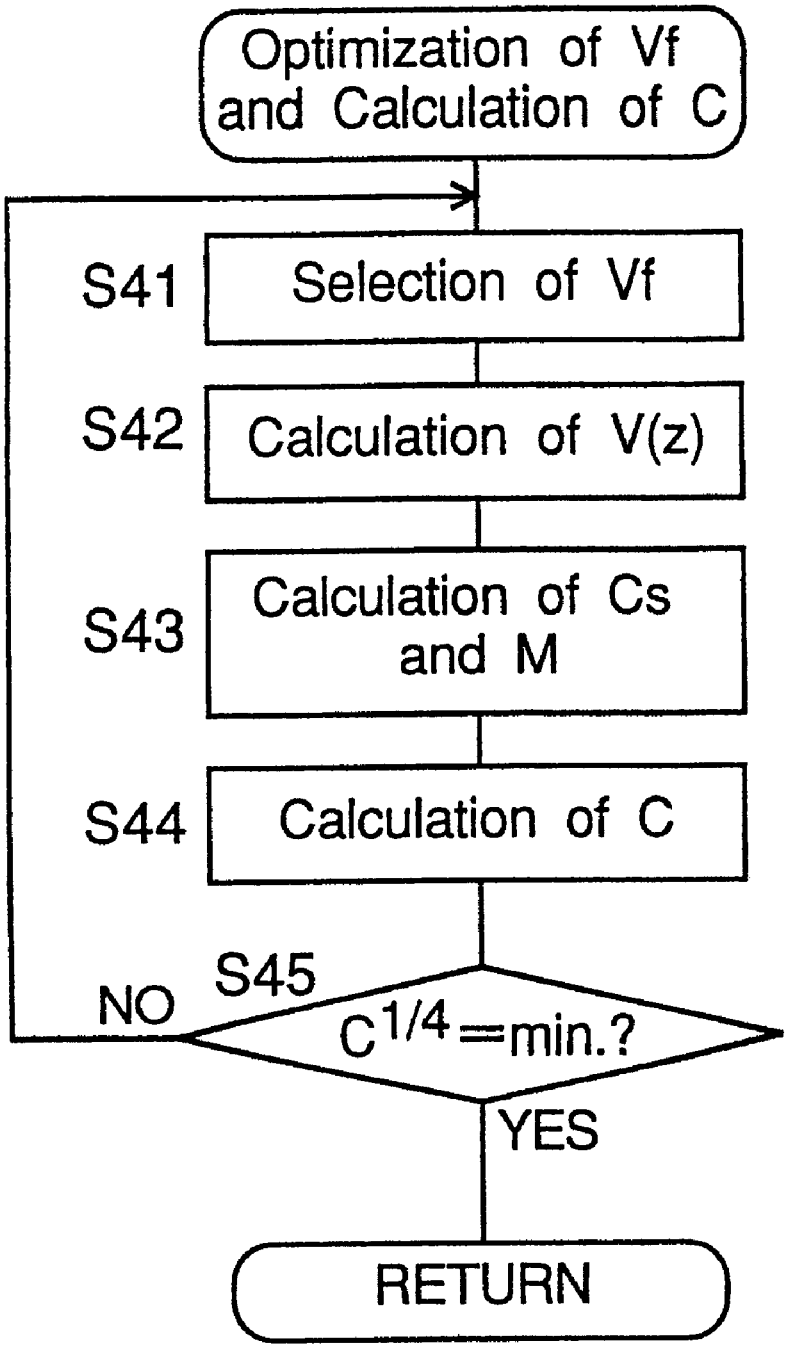
FIG. 4 illustrates a flow chart of a method for optimizing a focusing voltage Vf and the beam spot coefficient C.

When it is ascertained, in step S45 , that $C^{1/4}$ is approximately equal to the minimum value, the routine of FIG. 4 is completed, and the optimized focusing voltage Vf and the calculated beam spot coefficient C at that point are returned as the results of step S4 in FIG. 3, and the procedure advances to step S5 (in FIG. 3).

At step S5 , it is determined whether the beam spot coefficient C is approximately equal to the minimum value. If the determination is negative, the procedure loops back to step S2, so that steps S2 to S5 are repeated until such time as the beam spot coefficient C is approximately equal to the minimum value.

It is noted that steps S2 to S5 comprise a first process loop, whereby the lengths B1 to Bn+1 of the cylindrical film segments 10*a* to 10*g* and the lengths A1 to An of the coil segments 11*a* to 11*f* are determined as a second resistance distribution with which the beam spot coefficient C is minimized.

When it is determined at step S5 that the beam spot coefficient C is substantially minimized, the minimum value C0 of the beam spot coefficient C and the minimum value M0 of the magnification M are set in step S6.

In this regard, it is noted that the resistance distribution Rz determined by the process through step S6 can be determined by various commonly known methods, including, for example, a steepest-descent method or a conjugate gradient type method.

After the first process loop is executed, processing proceeds to step S7, at which an aberration-independent function F is calculated in accordance with equation (3), below, after which, a new beam spot coefficient Cm is calculated in accordance with equation (1), below.

$$Cm = (1-a)\cdot M^4 \cdot Cs \cdot \left(\frac{Vs}{V0}\right)^{\frac{3}{2}} + a \cdot F \tag{1}$$

where "a" represents a modification parameter between 0 and 1.

$$F = \left(\frac{M}{M0}\right)^4 \cdot C0 \tag{3}$$

Whether the beam spot coefficient Cm is approximately equal to the minimum value is then determined at step S8. If the beam spot coefficient Cm is not approximately equal to the minimum value, the procedure loops back to step S2, and steps S2 to S8 are repeated, until such time as it is determined that the value of the beam spot coefficient Cm is minimized.

It is noted that steps S2 to S8 comprise a second process loop.

When it is determined, at step S8. that the value of the beam spot coefficient Cm has been substantially minimized, an optimum resistance distribution Rzm is determined, based upon the lengths B1 to Bn+1 of the cylindrical film segments 10*a* to 10*g* and the lengths A1 to An of the coil segments 11*a* to 11*f* at that time.

It is noted that the manufacturing method of the present invention can be achieved using, for example, a computer simulation or other modeling technique.

Parameter "a" will now be described.

The results of the trial to be described below were obtained under the following conditions: the emission-side voltage Vs and the incidence-side voltage V0 were both equal to 30,000 volts; inside diameter D of the tubular substrate 6 was equal to 10 mm; the length of the glass tube was equal to 60 mm; the distance from the position (Z=Z0) of the electro-optical object point produced by the electron gun to the position (Z=Z8*a* ) on the z-axis of the electrical connector 8*a* was equal to 20 mm; and, the distance from the electrical connector 8*b* to the image point (Z=Zs) on the screen 4 was equal to 140 mm.

Figure 6:
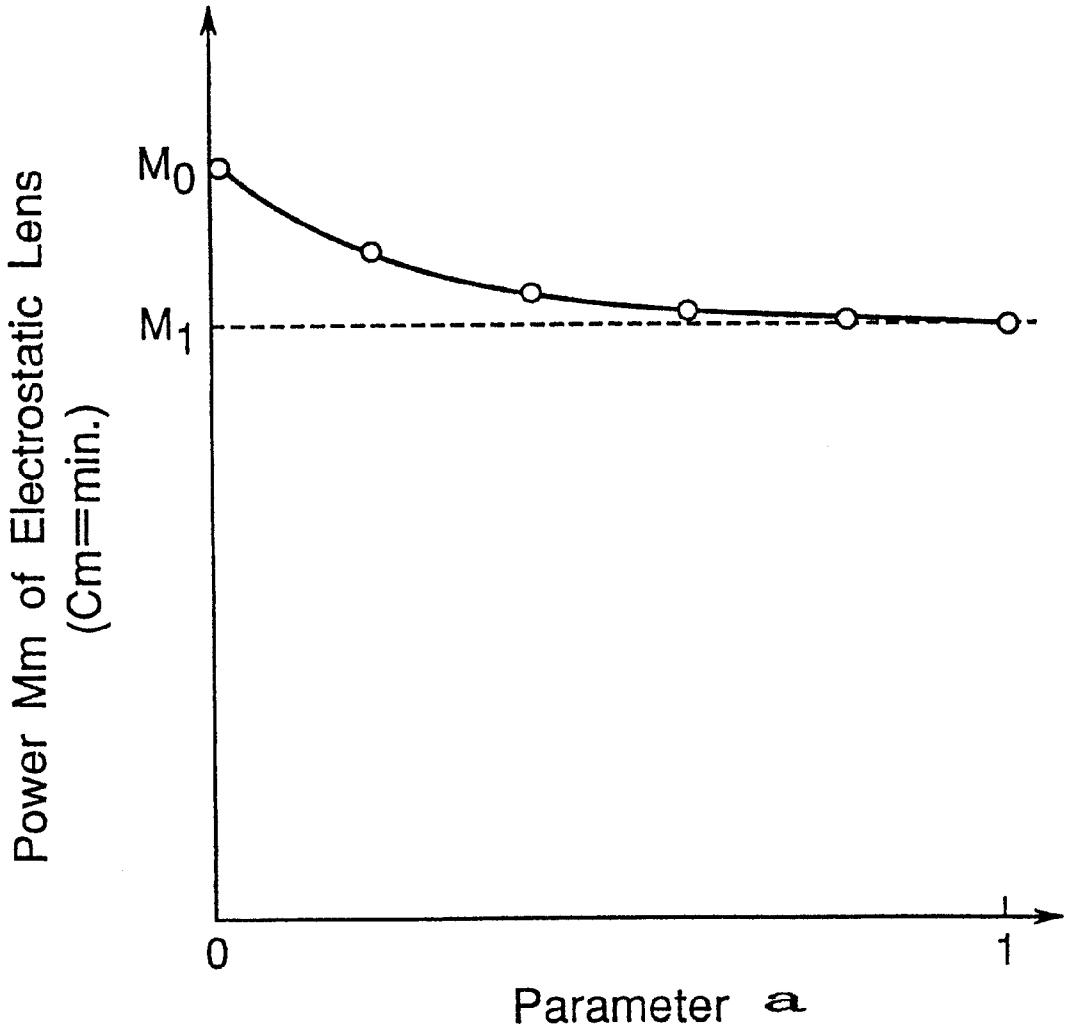
FIG. 6 illustrates a graph for describing a relationship between a parameter "a" and a magnification Mm of an electrostatic lens.

FIG. 6 illustrates a graph of the relationship between parameter "a" and the electrostatic lens magnification Mm when the beam spot coefficient Cm is the smallest.

When parameter "a" is equal to 0, equations (1) and (2), above, are the same, and thus, Cm is equal to C. Thus, magnification M becomes equal to magnification M0. In the present embodiment, magnification M0 is approximately equal to 3.

The aberration-independent function F is dependent upon the magnification M, but is not dependent upon the spherical aberration coefficient Cs. Therefore, when parameter "a" is greater than 0, the value of the electrostatic lens magnification Mm at which the beam spot coefficient Cm is smallest is less than the value of the magnification M0.

As the value of parameter "a" increases (e.g., becomes closer to 1), the value of the electrostatic lens magnification Mm decreases to a minimum magnification M1, wherein the minimum magnification M1 is dependent upon, for example, the distance from the electron beam emission point (Z=Z0) inside the electron beam formation region 9 to the electrical connector 8*a* (Z=Z8*a* ), the distance from the electrical connector 8*b* (Z=Z8*b* ) to the image point (Z=Zs), and the length Lg of the glass tube of the electrostatic lens 5*a*.

Parameter "a" in Equation (1) represents a ratio obtained by combining the aberration-dependent Equation (2) with the aberration-independent function F of Equation (3).

Using Equations (1), (2) and (3), Equation (1) can be re-written as follows:

$$Cm=(1-a)\cdot C+\alpha\cdot F$$

where:

$$a=\frac{(Cm-C)}{(F-C)}$$

The aberration-independent function F of Equation (3) was linearly combined with aberration-dependent Equation (2) to obtain an optimized minimum beam spot size, and the values are plotted using parameter "a" from 0 (corresponding to a conventional, prior art, electron gun) to 1.0 in 0.2 increments. In the electron gun of the current invention, it was found that the value of parameter "a" in the range of 0<a<0.4, and in particular, around approximately 0.2, is the optimum value for parameter "a".

Figure 7:
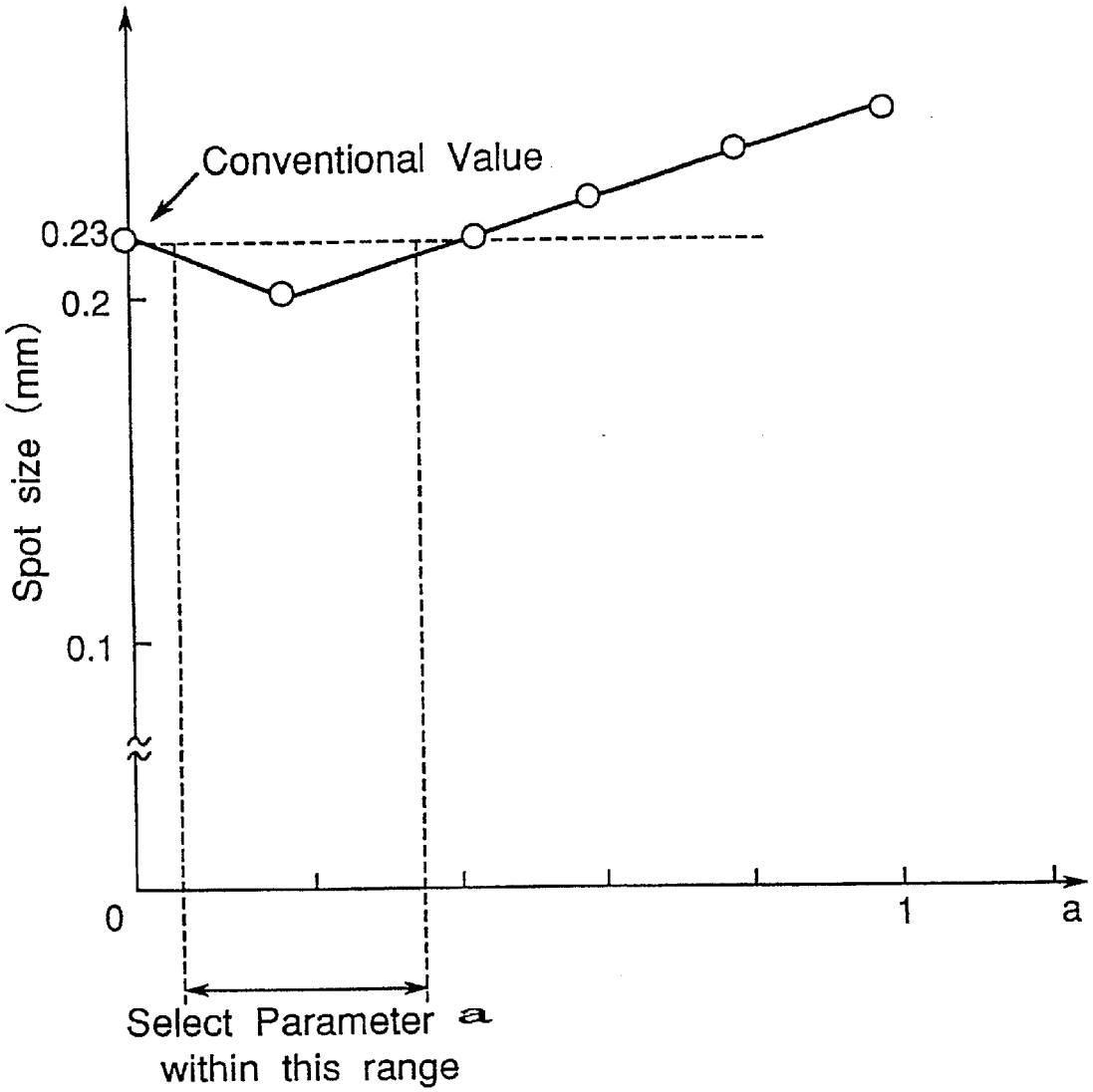
FIG. 7 illustrates a graph for describing a relationship between the parameter "a" and a spot diameter.

It is noted that in addition to the above, experimental tests were performed to obtain empirical results to confirm the optimal value that was theoretically determined for parameter "a" in relation to the beam spot size and the magnification Mm, the results of which are shown in FIGS. 6 and 7.

In the experimental tests, the outer size (diameter) and operation conditions of the electron gun of the instant invention are substantially the same as a conventional electron gun. Specifically, the outer diameter of the glass portion of the electron gun in the CRT was approximately 29.1 mm, and the operational voltage was set to approximately 30,000 to 32,000 volts. A mean value of the electric current was approximately equal to a range of 0.5 to 1 mA. The maximum value of the electric current was approximately equal to 6 mA.

An experimental test was also conducted using a second example of an electron gun of the instant invention, in which the outer diameter of the glass portion of the electron gun was approximately 36.5 mm.

When parameter "a" is equal to 0, and the electron gun is designed according to the algorithm of the present invention, the electron gun having the size and diameter obtained by the designed results is actually produced. Then, the diameter of the beam spot was measured in the actually made-up electron gun. Subsequently, the measurement tests were repeated by plotting "a" equal to 0.2, 0.4, . . . , 0.8, and 1.0, in the same manner, to thereby obtain the results plotted in FIG. 7.

The necessity for the modification parameter value (e.g., parameter "a") is as follows: as noted above, the empirical data (e.g., experimental test results) obtained from an electron gun constructed in accordance with Equation (2), which (as previously noted) corresponds to Equation (1) of the current invention when "a" is equal to 0, fails to agree with the theoretical results provided by the computer simulation and thus, fails to produce a CRT in which the diameter of the beam spot is minimized. This discrepancy (difference) occurs in the conventional CRT because Equation (2) assumes that the electron beam is emitted from a single point beam source, without consideration of any aberration caused in the electron beam formation portion 9. In addition, since a plurality of electron beams are actually emitted, the electron beams act to repulse one another. This repulsion effect is also not taken into account in Equation (2).

Thus, it was determined that Equation (2) needs to be modified by the inclusion of a modification factor (e.g., parameter "a"), in order to ensure that the theoretical results obtained from a computer simulation conform to the experimental (empirical) results obtained from an actually constructed device. Parameter "a" of the current invention is incorporated into Equation (1) in order to take into account the above-noted spherical aberration and repulsion of the electron beams, in order to reduce the adverse effects thereof on the diameter of the beam spot.

Based upon empirical tests that were conducted, in which parameter "a" was varied, it was determined that the beam spot coefficients are minimized when parameter "a" is in the range of 0<a<0.4. Thus, employing Equation (1) in a computer simulation with an appropriately adjusted parameter "a" ensures that the diameter of the beam spot of an actually constructed device matches the results provided by the computer simulation.

As noted above, FIG. 7 illustrates a graph showing the relationship between parameter "a" and the measured spot diameter on the screen 4 of a CRT using an electron gun manufactured according to the manufacturing method of the present invention.

In this regard, it is also noted that the spot diameter is smallest when the value of parameter "a" is equal to approximately 0.2, which is why the value of parameter "a" is defined as being equal to 0.2 in the preferred embodiment of the invention.

An electron beam is emitted in the electron beam formation region 9 from a domain of a size greater than a single point. Equation (2), however, assumes that the electron beam is emitted from a single point, and an aberration in the electron beam formation region 9 is not taken into account in the equation. An interaction between the electron beams is also not considered by Equation (2). In this regard, the effect on the spot diameter of the aberration in the electron beam formation region 9 and the interaction between the electron beams decreases as the magnification decreases. That is, increasing parameter "a" decreases the magnification, and results in a reduction of the diameter of the electron beam spot.

Conversely, increasing the value of parameter "a" increases the spot diameter. This is because the spherical aberration increases as the value of parameter "a" increases. The effect of the increased spherical aberration is believed to be greater than the effect of reducing the magnification.

The spot diameter is believed to be the smallest when parameter "a" is approximately equal to 0.2. With a conventionally manufactured electron gun, i.e., an electron gun manufactured with parameter "a" equal to 0, the spot diameter is approximately equal to 0.23 mm (measured value). With an electron gun manufactured according to the present invention, in which parameter "a" has a value equal to approximately 0.2, the smallest spot diameter is approximately equal to 0.2 mm (measured value). It is noted that the focusing voltage Vf at this time is approximately equal to 7,000 volts.

By selecting the value of parameter "a" from within the domain contained by the dotted line shown in FIG. 7, it is possible to achieve a spot diameter that is smaller than that obtainable with a conventionally produced electron gun.

It is noted that the optimum value of parameter "a" presented herein is dependent upon such conditions as the distance to the screen 4 from the electrostatic lens 5*a*, and the distance to the electron beam formation region 9 from the electrostatic lens 5*a*. Accordingly, the value for parameter "a" presented herein is not to be taken as the optimum value under all construction circumstances, and the invention shall not be limited to the values described herein.

It is also noted that electrostatic lens 5*a* of the present embodiment of the invention comprises a unipotential electrostatic lens, in which the incidence-side voltage V0 and the emission-side voltage Vs are equal. However, it is understood that the manufacturing method of the invention can also be applied to, for example, a bi-potential electrostatic lens in which the incidence-side voltage V0 and emission-side voltage Vs differ without departing from the spirit and/or scope of the invention.

Furthermore, while the electrostatic lens 5*a* of the present embodiment comprises a tubular substrate 6 having electrical insulation properties and a resistive structure 7*a* formed on the inside surface of this tubular substrate 6, the electrostatic lens can be made using a tubular ceramic or other resistive structure without departing from the spirit and/or scope of the invention.

It is further noted that a color cathode ray tube can be achieved, for example, by a construction that disposes plural electrostatic lenses according to the present invention in a single cathode ray tube, or by a construction that focuses plural electron beams using a single electrostatic lens in a cathode ray tube.

How the manufacturing method of the present invention addresses the problem of stability in the beam spot diameter over time will now be described.

Figure 8:
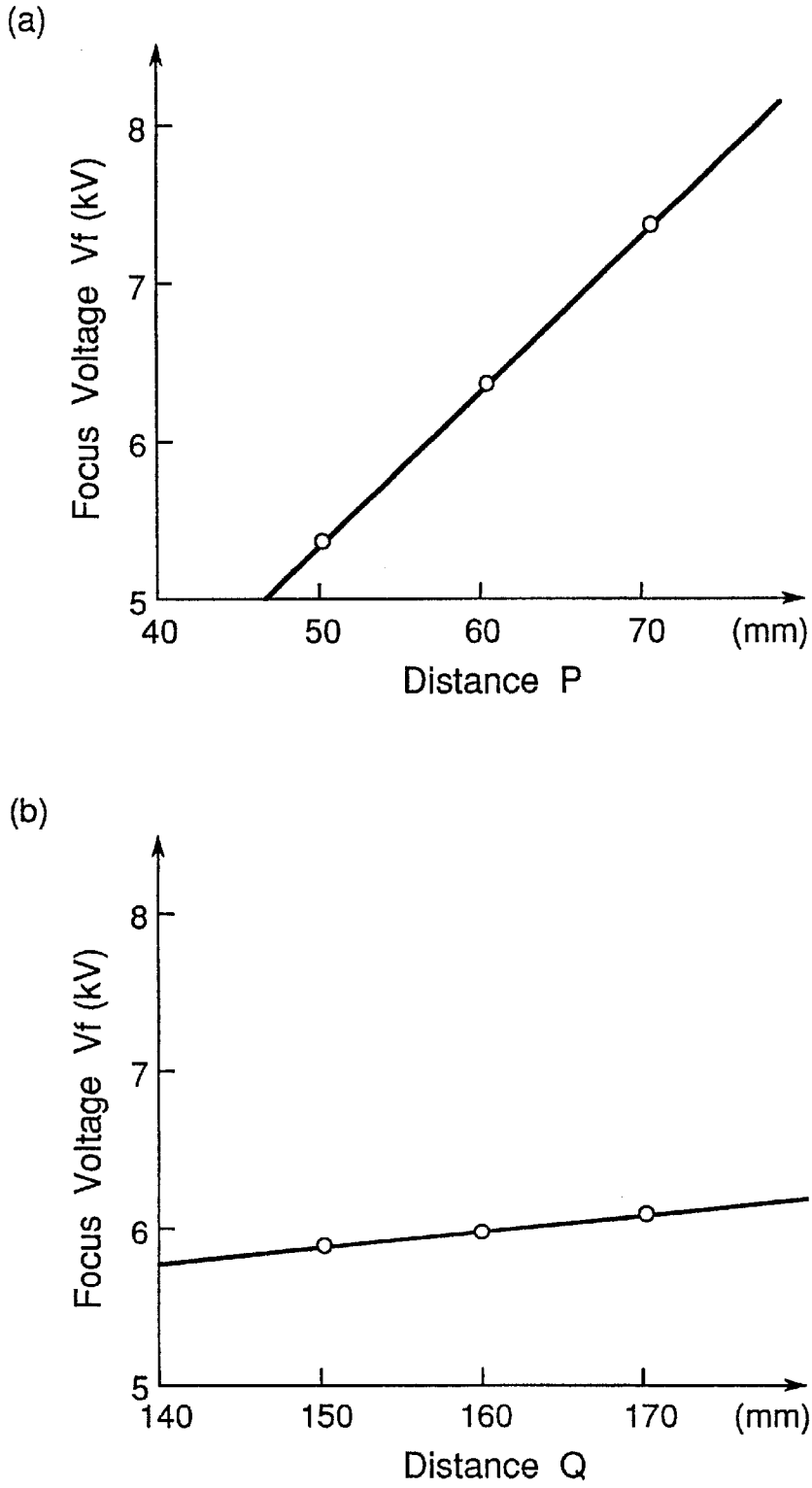
FIGS. 8(*a*) and 8(*b*) show a graph for describing a relationship between a focusing voltage Vf and a position of a primary plane of the electrostatic lens.

FIG. 8(*a*) represents a graph illustrating the relationship between the focusing voltage Vf and the distance P from the electro-optical object point to the primary plane 25 of the electrostatic lens 5*a*. FIG. 8(*b*) represents a graph illustrating the relationship between the focusing voltage Vf and the distance Q from the primary plane 25 of the electrostatic lens 5*a* to the screen 4.

As shown in FIGS. 8(*a*) and 8(*b*), the focusing voltage Vf increases as the distance P increases, and as the distance Q increases. While the distance Q decreases when the distance P increases, the change in distance P has a greater effect on the focusing voltage Vf than the change in distance Q has on the focusing voltage Vf. A high focusing voltage Vf can thus be obtained by increasing the distance P and repeating the process. As shown in FIG. 8(*a*), the focusing voltage Vf is approximately equal to 6,500 volts when the distance P is equal to approximately 60 mm, and is approximately 7,200 volts when the distance P is equal to approximately 70 mm.

A voltage difference between the incidence-side voltage V0 and the emission-side voltage Vs decreases as the focusing voltage Vf increases. Thus, the voltage load on the resistive structure can be reduced. More specifically, the electrical stability of the resistive structure can be improved.

It is therefore possible to reduce a time-based variation in the beam spot diameter by means of the manufacturing method of the present invention.

Selected sample data that has been calculated by applying the manufacturing method of the present invention is shown in Table 1, below. It is noted that the data in Table 1 is presented as an example, and that the present invention is not limited to the values presented therein.

TABLE 1

| | Example 1 | Example 2 |
|---|---|---|
| A1 | 12.30 | 10.50 |
| A2 | 1.50 | 1.80 |
| A3 | 1.20 | 0.90 |
| A4 | 0.90 | 0.60 |
| A5 | 0.60 | 0.60 |
| A6 | 0.60 | 0.60 |
| A7 | 0.90 | 0.60 |
| A8 | 1.20 | 0.90 |
| A9 | 1.50 | 1.80 |
| A10 | 12.30 | 10.50 |
| B1 | 7.05 | 17.15 |
| B2 | 0.60 | 1.20 |
| B3 | 1.50 | 1.50 |
| B4 | 1.50 | 1.50 |
| B5 | 2.90 | 2.40 |
| B6 | 11.10 | 8.10 |
| B7 | 2.90 | 2.40 |
| B8 | 1.50 | 1.50 |
| B9 | 1.50 | 1.50 |
| B10 | 0.60 | 1.20 |
| B11 | 3.85 | 3.85 |
| $Cm^{1/4}$ | 2.647 | 2.668 |
| Cs | 1.555 | 0.88 |
| Vf (optimum) | 8,640 Volts | 8,640 Volts |

(unit: mm)

The data provided in Table 1, above, is based upon the following initial values:

Lg=72 mm
P=55.2 mm
Q=164 mm
V0=30,000 volts
Vs=30,000 volts
Vf=8,000 volts
n=10
a=0.2
pitch=0.3 mm

Embodiment 2

The following discussion will be presented with respect to a second embodiment of the instant invention. In tests performed with the manufacturing method of the present invention described above, in which the beam current in the electron gun 2*a* was increased, it was not possible to sufficiently suppress changes in the beam spot diameter over time. An electron gun constructed in accordance with the second embodiment of the present invention addresses this problem.

Figure 9:
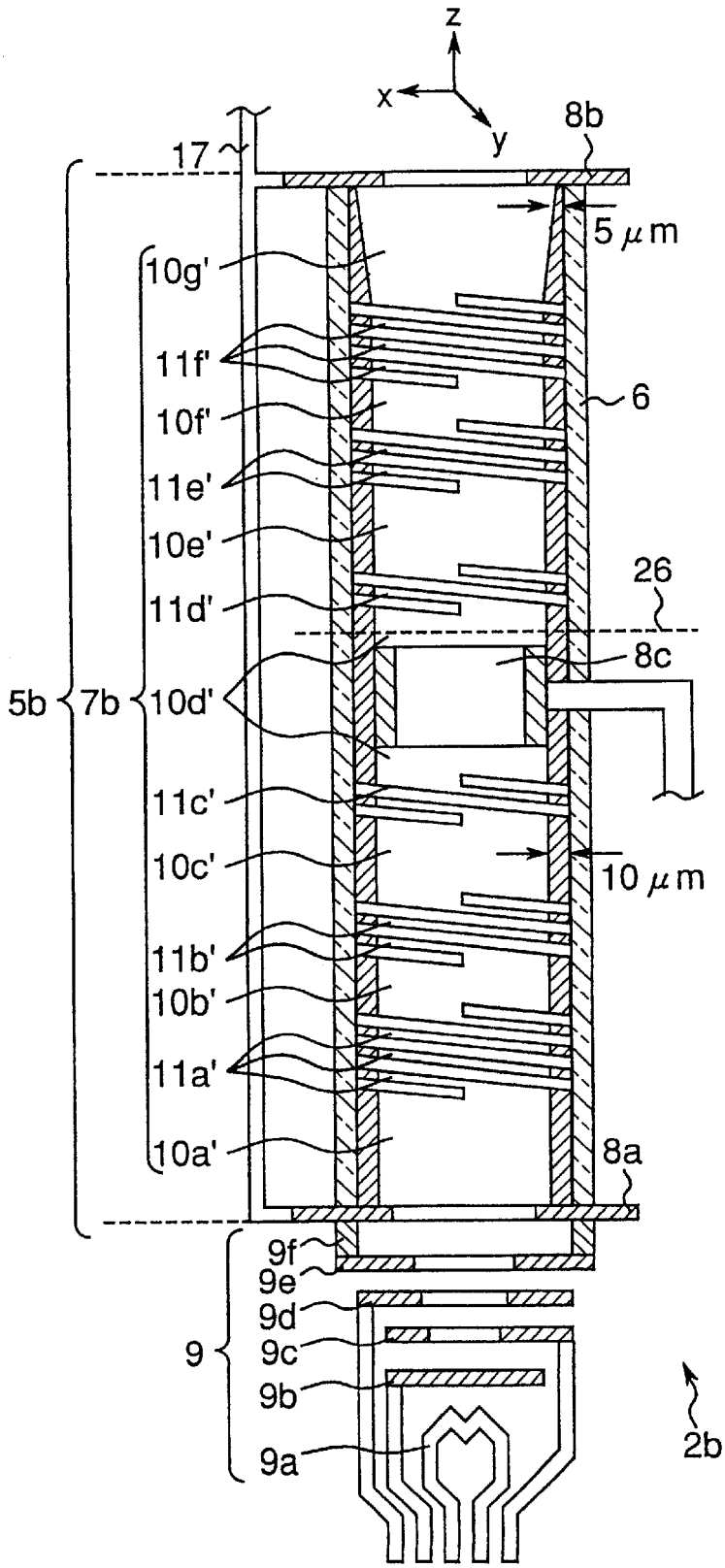
FIG. 9 depicts a cross section of an electron gun according to a second embodiment of the present invention.

FIG. 9 represents a cross section of an electron gun according to the second embodiment of the present invention. As shown in FIG. 9, the electron gun 2*b* comprises an electrostatic lens 5*b* and an electron beam formation region 9. It is noted that the electrostatic lens 5*b* of the second embodiment is identical to the electrostatic lens 5*a* of the first embodiment, except for the resistive structure 7*b*. The resistive structure 7*b* of the second embodiment comprises a plurality of cylindrical film segments 10*a*' to 10*g*', and a plurality of coil segments 11*a*' to 11*f*.

A distinctive feature of the resistive structure 7*b* is that the film thickness on the electron beam emission side in the area of the electrical connector 8*b* is thinner than an average overall film thickness. In particular, the average film thickness of the resistive structure 7*b* of the second embodiment is approximately 10 $\mu$m, while the thickness of the emission-side film is approximately 5 $\mu$m.

Reducing (decreasing) the emission-side film thickness effectively increases the sheet resistance in that area, and thus, increases the field strength on the emission side of the resistive structure 7*b*. In this regard, primary plane 26 of the electrostatic lens 5*b* is offset towards the emission side. As a result, the distance P from the electro-optical object point to the primary plane 26 of the electrostatic lens is increased, while the distance Q from the primary plane 26 of the electrostatic lens to the image point is decreased. As described above with reference to FIG. 8(*a*), the focusing voltage Vf increases when the distance P increases.

Figure 10:
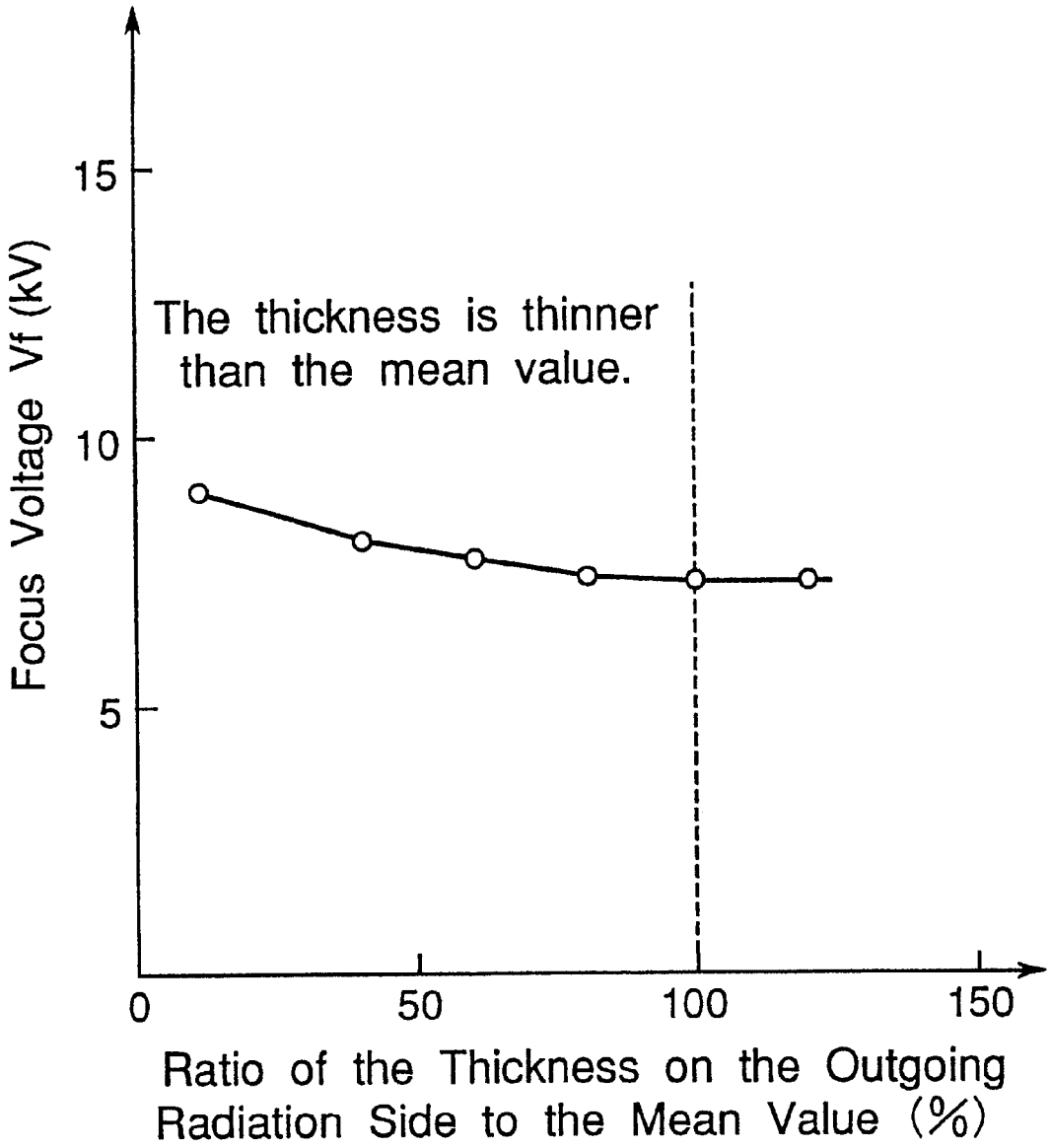
FIG. 10 illustrates a graph for describing a relationship between the focusing voltage Vf and a ratio of an emission-side film thickness to an average film thickness.

FIG. 10 represents a graph illustrating a relationship between the focusing voltage Vf and a ratio of the emission-side film thickness to the average film thickness of the resistive structure 7*b*. As shown in FIG. 10, the focusing voltage Vf increases as the ratio of the emission-side film thickness to the average film thickness decreases.

The difference between the focusing voltage Vf and the incidence-side voltage V0 or the emission-side voltage Vs decreases when the manufacturing method of the present invention is applied to an electron gun employing the resistive structure 7*b* described above, and, thus, the voltage load on the resistive structure 7*b* can be reduced.

Therefore, it is possible to retain a stable beam spot diameter over time, even when the beam current increases.

One example of a method for manufacturing the resistive structure 7*b* of the second embodiment of the invention will now be described below with reference to FIGS. 11(*a*) and 11(*b*).

Figure 11:
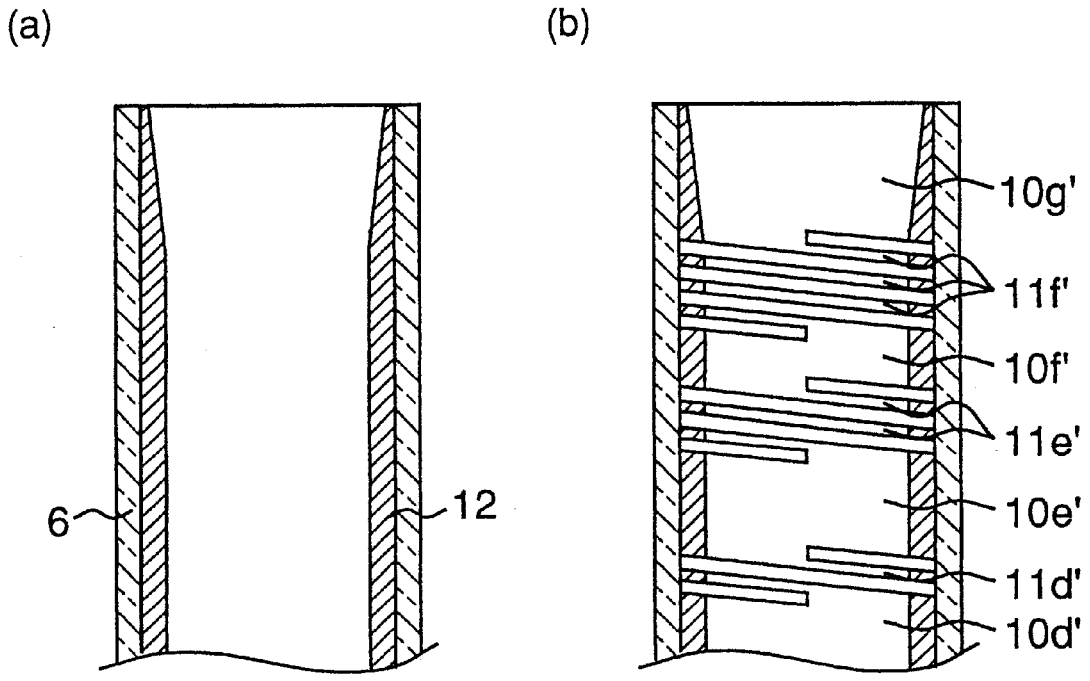
FIGS. 11(*a*) and 11(*b*) illustrate a process diagram for describing a method for manufacturing a resistance structure according to the second embodiment of the present invention.

A resistive coating solution of ruthenium dioxide, glass paste, and an organic solvent is deposited on the inside surface of the glass tube substrate 6, and baked to form a resistive film 12 (see FIG. 11(*a*). If this process is performed with the tubular substrate 6 in an upright position, the resistive film coating will naturally flow downward, due to gravity. As a result, the thickness of the resistive film 12 naturally becomes thinner at the top thereof.

Coil segments 11*a*' to 11*f*' are formed by scraping (or cutting) a spiral pattern into the resistive film 12 at predetermined locations using a blade or other tool, as shown in FIG. 11(*b*). The parts of the resistive film 12 that are not removed to form the coil segments 11*a*' to 11*f*' remain to form the cylindrical film segments 10*a*' to 10*g*', such that a specific resistance distribution is obtained in the resistive structure 7*b*.

Accordingly, it is possible to manufacture a resistive structure 7*b* in which the film thickness on the emission-side of the resistive structure 7*b* is less than the overall average film thickness of the resistive structure 7*b*.

It is noted that the emission-side film thickness of the resistive structure 7*b* is reduced in the disclosed embodiment in order to increase the emission-side resistance. However, the same effect can be achieved even if the film thickness is constant (or the emission-side film thickness is greater than the average thickness insofar as the specific resistance at the emission side of the resistive structure 7*b* is greater than the average specific resistance of the film).

Embodiment 3

Figure 12:
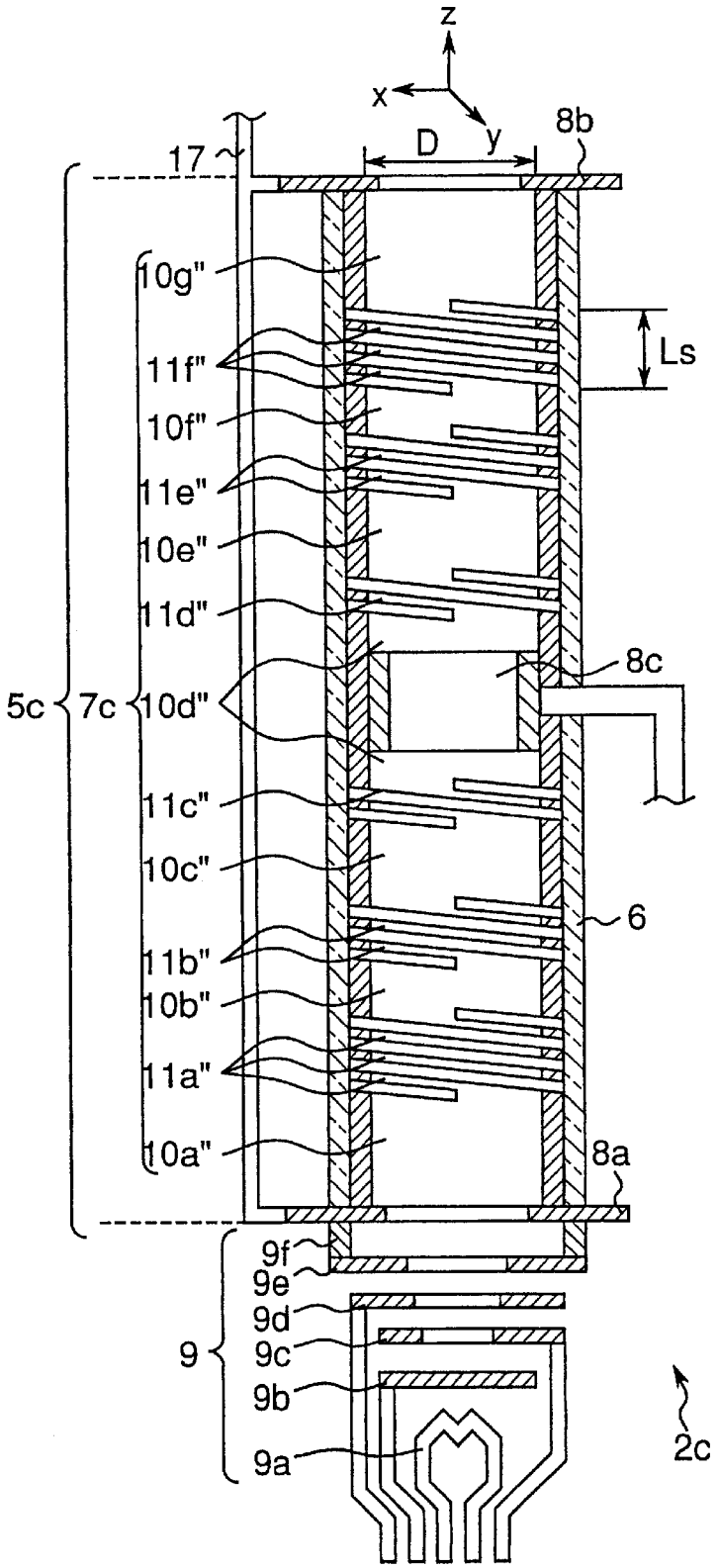
FIG. 12 shows a cross section of an electron gun according to a third embodiment of the present invention.

An electron gun constructed in accordance with a third embodiment of the present invention will now be described below with reference to FIG. 12. Electron gun 2*c* of the third embodiment comprises an electrostatic lens 5*c* and an electron beam formation region 9. The construction of the electrostatic lens 5*c* corresponds to the construction of the electrostatic lenses 5*a* and 5*b* of the first and second embodiments, respectively, except for the construction of the resistive structure 7*c*. The resistive structure 7*c* of the third embodiment comprises a plurality of cylindrical film segments 10*a*" to 10*g*", and a plurality of coil segments 11*a*"–11*f* ".

The distinctive feature of the resistive structure 7*c* of the third embodiment is that inside diameter D of the tubular substrate 6 and length Ls of the coil segment 11*f*" closest to the emission side satisfy equation (6), below.

$$Ls \leqq D \tag{6}$$

In the third embodiment of the invention, the inside diameter D is approximately equal to 10 mm and the length Ls is approximately equal to 8 mm.

Actual tests performed on an electron tube constructed in accordance with the present invention indicate that the spherical aberration of the electrostatic lens is relatively small when the coil segments 11*d*" to 11*f*" become sequentially longer from the electrical connector 8*c* towards the electrical connector 8*b*. Further, operating tests, in which a specified voltage is applied to drive the electron gun 2*c*, indicate that images are displayed with a stable brightness over time.

Figure 13:
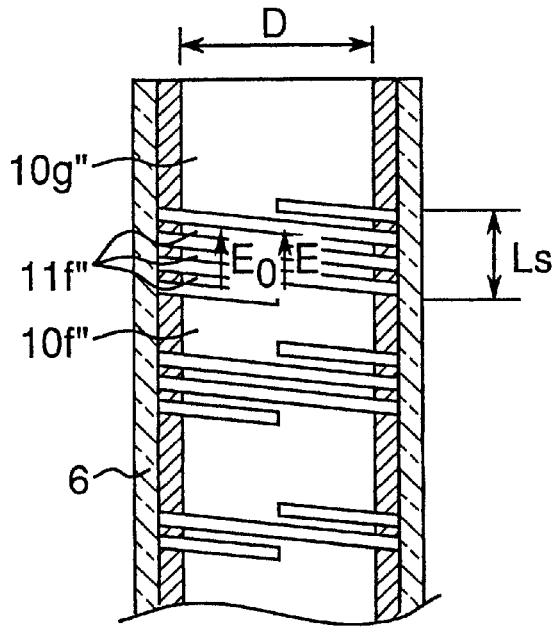
FIGS. 13(*a*) and 13(*b*) describe a relationship between a field strength E0 proximal to a coil member and a field strength E near a center of the coil member.
Figure 13:
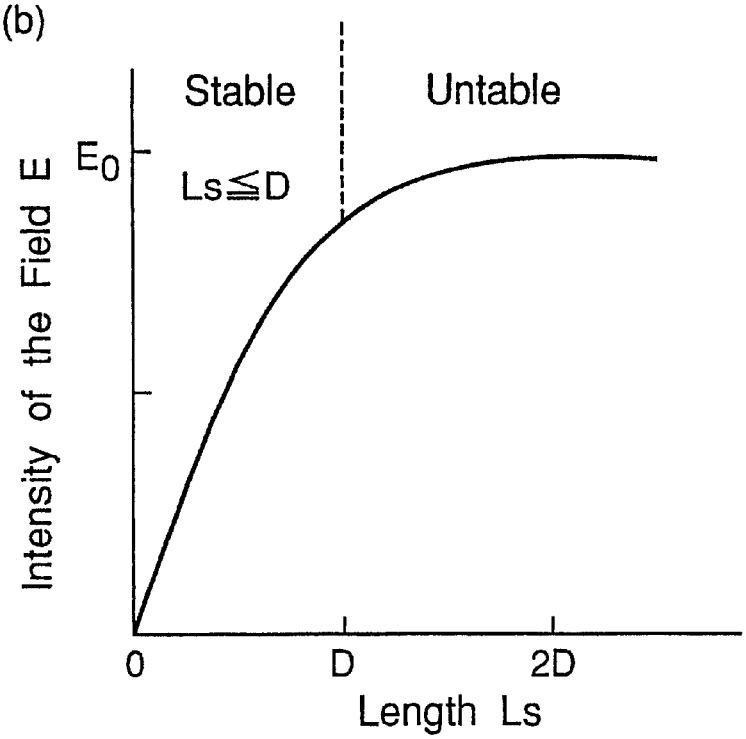

A field strength E0 around coil segment 11*f*" and a field strength E near an axis of coil segment 11*f*" are shown in FIG. 13(*a*), While a graph depicting the relationship between the field strength E and the length Ls of coil segment 11*f*" is shown in FIG. 13(*b*).

FIG. 13(*b*) shows that when the length Ls becomes greater than the inside diameter D of the tubular substrate 6, the field strength E near the axis of the coil is approximately equal to the field strength E0 around coil segment 11*f*". A slight change in the field strength E0 is accompanied by a change in the field strength E near the axis of the coil.

When the length Ls is less than (or equal to) the inside diameter D, the region surrounding the cylindrical film segments 10*f*" and 10*g*" is substantially field-free and stable over time, and a variation in the internal field strength E is reduced. Thus, it is possible to reduce a time-based change in the diameter of the beam spot.

It is noted that the time-based change in the diameter of the beam spot can be further reduced by combining the structural features of the second embodiment with those of the third embodiment.

Furthermore, if an electron gun is manufactured combining the structural features of the second and third embodiments, a cathode ray tube for displaying high resolution images with a stable brightness over time can be achieved.

The foregoing discussion has been provided merely for the purpose of explanation and is in no way to be construed as limiting the present invention.

While the present invention has been described with reference to exemplary embodiments, it is understood that the words which have been used herein are words of description and illustration, rather than words of limitation. Changes may be made, within the purview of the appended claims, as presently stated and as amended, without departing from the scope and/or spirit of the present invention in its various aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims. Alternative software implementations including, but not limited to, distributed processing or component/object distributed processing, parallel processing, or virtual machine processing can also be constructed to implement the methods described herein. In addition, although the present specification describes components and functions implemented in the embodiments with reference to particular standards and protocols, the invention is not limited to such standards and protocols.

The present disclosure relates to subject matter contained in Japanese Patent Application No. HEI 8-89221, filed on Apr. 11, 1996, which is expressly incorporated herein by reference in its entirety.

We claim:

1. An electrostatic lens for focusing an electron beam produced by an electron beam formation region of an electron gun, comprising:

a tubular substrate; and a resistive structure having a predetermined resistance distribution, said resistive structure satisfying the following equation:

$$Cm = (1-a)\cdot M^4\cdot Cs\cdot\left(\frac{Vs}{V0}\right)^{\frac{3}{2}} + a\cdot F$$

where:

Cm equals a minimized beam spot coefficient;

a equals a modification parameter;

M equals a magnification of the electrostatic lens;

Cs equals a spherical aberration coefficient of the electrostatic lens;

Vs equals an emission-side voltage;

V0 equals an incidence-side voltage; and

F equals an aberration-independent function.

2. The electrostatic lens of claim 1, wherein said aberration-independent function is determined in accordance with the following equation:

$$F = \left(\frac{M}{M0}\right)^4\cdot C0$$

where:

M0 equals a minimum value of the magnification M; and

C0 equals a minimum beam spot coefficient value.

3. The electrostatic lens of claim 1, wherein said modification parameter a is within the range $0<a<1$.

4. The electrostatic lens of claim 1, wherein a film thickness of said resistive film on said emission side of said electron beam is thinner than an average film thickness of an entire resistance film.

* * * * *

UNITED STATES PATENT AND TRADEMARK OFFICE

CERTIFICATE OF CORRECTION

PATENT NO. : 6,328,621 B2
DATED : December 11, 2001
INVENTOR(S) : M. Kudoh et al.

It is certified that error appears in the above-identified patent and that said Letters Patent is hereby corrected as shown below:

Column 9,
Line 13, after "Vf" insert -- . --.

Column 11,
Line 17, the term "C + α ·F" should be -- C + a ·F --.

Signed and Sealed this

Twenty-fourth Day of June, 2003

JAMES E. ROGAN
*Director of the United States Patent and Trademark Office*